United States Patent [19]

Satoh et al.

[11] Patent Number: 4,728,473

[45] Date of Patent: Mar. 1, 1988

[54] PROCESS FOR PREPARATION OF POLYPARAPHENYLENE TEREPHTHALAMIDE FIBERS

[75] Inventors: Eiji Satoh; Jun Yamaguchi, both of Nobeoka, Japan

[73] Assignee: Asahi Kasei Kogyo Kabushiki Kaisha, Osaki, Japan

[21] Appl. No.: 583,659

[22] Filed: Feb. 27, 1984

[30] Foreign Application Priority Data

Feb. 28, 1983 [JP] Japan ..... 58-31001
Oct. 24, 1983 [JP] Japan ..... 58-197600

[51] Int. Cl.[4] ..... D01D 5/06

[52] U.S. Cl. ..... 264/101; 264/180; 264/181; 264/184; 264/210.3; 264/210.8; 264/211.16

[58] Field of Search ..... 264/181, 184, 210.8, 264/203, 204, 205, 180, 211.16, 210.3, 101; 425/66.71, 376 R, 382.2

[56] References Cited

U.S. PATENT DOCUMENTS

| | | | |
|---|---|---|---|
| 3,414,645 | 12/1968 | Morgan, Jr. | 264/184 |
| 3,488,344 | 1/1970 | Biffi et al. | 264/181 |
| 3,671,542 | 6/1972 | Kwolek | 264/210.5 |
| 3,767,756 | 10/1973 | Blades | 264/184 |
| 3,842,151 | 10/1974 | Stoy et al. | 264/203 |
| 3,869,430 | 3/1975 | Blades | 264/184 |
| 3,940,955 | 3/1976 | Welsh | 264/184 |
| 3,996,321 | 12/1976 | Weinberger | 264/184 |
| 4,016,236 | 4/1977 | Nagasawa et al. | 264/184 |
| 4,048,279 | 9/1977 | Zimmerman | 264/184 |
| 4,070,431 | 1/1978 | Lewis et al. | 264/184 |
| 4,078,034 | 3/1978 | Lewis | 264/184 |
| 4,298,565 | 11/1981 | Yang | 264/184 |
| 4,320,081 | 3/1982 | Lammers | 264/184 |
| 4,340,559 | 7/1982 | Yang | 264/184 |
| 4,368,615 | 1/1983 | Lammers | 264/184 |

FOREIGN PATENT DOCUMENTS

| | | | |
|---|---|---|---|
| 0051265 | 5/1982 | European Pat. Off. | 264/184 |
| 2900264 | 7/1979 | Fed. Rep. of Germany | 264/184 |
| 0006417 | 2/1973 | Japan | 264/184 |
| 0053069 | 4/1977 | Japan | 264/184 |
| 0043986 | 4/1978 | Japan . | |
| 0005845 | 2/1981 | Japan | 264/184 |
| 0031009 | 3/1981 | Japan | 264/184 |
| 0154408 | 9/1982 | Japan | 264/184 |
| 2044668 | 10/1980 | United Kingdom | 264/184 |
| 2044669 | 10/1980 | United Kingdom | 264/184 |
| 2068822 | 8/1981 | United Kingdom . | |

*Primary Examiner*—Jan H. Silbaugh
*Assistant Examiner*—Hubert C. Lorin
*Attorney, Agent, or Firm*—Finnegan, Henderson, Farabow, Garrett, & Dunner

[57] ABSTRACT

A process for the preparation of poly-p-phenylene terephthalamide fibers according to the wet spinning method comprising passing an optically anisotropic solution of a poly-p-phenylene terephthalamide type polymer through a non-coagulating fluid layer and guiding the solution to a coagulating bath, characterized in that (a) filaments are taken out together with a stream of a coagulating solution from fine tube or fine hole arranged in the lower portion of the coagulating bath and the filaments are travelled through a second fine tube or fine hole arranged below said fine tube or fine hole through a space, and (b) in the fine tube or fine hole arranged in the lower portion of the coagulating bath, the stream of the coagulating solution flowing out together with the filaments is accelerated and in the second fine tube or fine hole, the speed of the stream of coagulating solution accompanying the filaments is decreased.

13 Claims, 7 Drawing Figures

PROCESS FOR PREPARATION OF POLYPARAPHENYLENE TEREPHTHALAMIDE FIBERS

BACKGROUND OF THE INVENTION

1. Field of the Invention

The present invention relates to a process and apparatus for the preparation of poly-p-phenylene terephthalamide (hereinafter referred to as "PPTA" for brevity) fibers. More particularly, the present invention relates to a high-speed spinning process for preparing PPTA fibers having improved mechanical properties at a high efficiency at an industrially advantageous speed, and to a spinning apparatus for use in such a process.

2. Description of the Prior Art

It is known that wholly aromatic polyamides are derived from an aromatic diamine and an aromatic dicarboxylic acid and/or an aromatic aminocarboxylic acid, and it also is known that fibers are obtained from these aromatic polyamides. Furthermore, it is known that of these aromatic polyamides, PPTA type polymers provide fibers having such preferred properties as high melting point, excellent crystallinity, high strength and high Young's modulus, as expected from the rigid molecular structure thereof.

For example, U.S. Pat. No. 3,767,756 teaches that fibers having preferred mechanical properties can be obtained by extruding an optically anisotropic solution of a PPTA type polymer in concentrated sulfuric acid having a concentration of at least 98% through an orifice into an inert non-coagulating fluid and then passing the extrudate through a coagulating bath. In this process, however, a large take-up tension, that is, a large spinning tension, is imposed on filaments by the frictional resistance between the coagulating solution in the coagulating bath and the travelling filaments. This spinning tension is increased with increase of the spinning speed. Accordingly, under a low spinning tension, that is, at a low spinning speed, fibers having excellent mechanical properties can be obtained, but with increase of the spinning speed, the strength and elongation of the obtained fibers are drastically reduced. Therefore, it is very difficult to obtain PPTA fibers having excellent mechanical properties at an industrially significant spinning speed.

As means for reducing the spinning tension which tends to extremely increase with increase of the spinning speed, there has been proposed a process in which a specifically designed spin tube having a fine hole is arranged in the lower portion of the coagulating bath and spinning is carried out while letting filaments and the coagulating solution simultaneously fall down (see U.S. Pat. No. 4,078,034). Even if this process is adopted, however, it is impossible to sufficiently reduce the tension and obtain fibers having high mechanical properties at a high spinning speed, especially a spinning speed higher than 300 m/min.

As means for reducing the frictional resistance caused by the speed difference between the coagulating solution and the filaments in a high spinning speed region, there have been proposed a process in which the solution in the coagulating bath is compressed to accelerate the coagulating solution extruded from the spin tube (see U.S. Pat. No. 4,070,431) and a process in which another coagulating solution jetted from a plurality of small-diameter nozzles or slits is caused to impinge in the yarn take-up direction against the filaments and accompanying coagulating solution stream falling down through the spin tube, whereby the coagulating solution stream is accelerated (see Japanese Unexamined Patent Publication (Kokai) No. 56-128312). It is possible to seemingly reduce the spinning tension by accelerating the coagulating solution. However, especially in the latter process, jets of the jetted coagulating solution are applied as excessive tensions to parts of the filaments to cause fracture of the higher order structure of the filaments in which coagulation is still incomplete, with the result that the strength and elongation are reduced and fibers having sufficiently high performances cannot be obtained.

As means for reducing the spinning tension, there has been proposed a process in which a spin tube is located at a very shallow position in the coagulating bath to decrease the amount of the coagulating solution falling down together with filaments and if necessary, a specific amount of another coagulating solution is jetted in the yarn take-up direction and caused to impinge against the filaments and coagulating solution falling down through the spin tube, whereby acceleration is effected (see Japanese Unexamined Patent Publication (Kokai) No. 57-121612). In this process, however, since the coagulating bath is shallow and the amount of the falling coagulating solution is reduced, the coagulation is more incomplete, and even if the tension is reduced, crystal orientation in the filaments and fracture of the higher order structure of the filaments are advanced simultaneously, resulting in reduction of the strength and elongation. Even if reduction of the strength is controlled by the effect of reducing the tension, only fibers having a low elongation are obtained. Of course, this tendency becomes conspicuous in a high spinning speed region because the force of inertia is increased with increase of the spinning speed. Furthermore, when an aqueous solution of sulfuric acid, use of which is very advantageous from the industrial viewpoint, is used as the coagulating solution, since the advance of coagulation is delayed at a high spinning speed, the above-mentioned tendency becomes more conspicuous and as the result, high performance PPTA fibers applicable to practical use cannot be obtained.

It is well-known that PPTA fibers applicable to practical use should have not only high strength but also a high elongation, and these two properties are especially important for the fatigue resistance when the fibers are used for tire cords.

SUMMARY OF THE INVENTION

Under the above-mentioned background, we made research with a view to developing a process capable of producing excellent PPTA fibers having not only a high strength but also a high elongation at a high efficiency at an industrially advantageous speed, especially on the formation of filaments from a solution of a PPTA type polymer in concentrated sulfuric acid (hereinafter referred to as "dope" for brevity) through coagulation and the physical properties and structure of the obtained PPTA fibers. As the result, it was found that in the wet spinning process comprising guiding a dope to a coagulating bath through a non-coagulating fluid layer, only when the spinning tension given for formation of filaments and the coagulation state determined by the removal of sulfuric acid satisfy a certain specific condition, PPTA fibers having high strength and high elongation and being excellent in other mechanical properties can be obtained. We furthered our research based on this finding, and it was found that if a fine tube or fine hole is arranged in the lower portion of a coagulating bath and the filaments are made to travel with the coagulating solution through the fine tube or fine hole, the falling coagulating solution is accelerated in the fine tube or fine hole and is then travelled in a space below the fine tube or fine hole and at some distance further below, the speed of the coagulating solution accompanying the filaments is then decreased, PPTA fibers having high strength and high elongation can be obtained even at such a high speed as at least 300 m/min, preferably at least 600 m/min. We have now completed the present invention based on this finding.

It is therefore a primary object of the present invention to provide a process and apparatus for preparing high-performance PPTA fibers having improved strength and elongation at a high efficiency at an industrially advantageous high speed.

In accordance with the present invention, there is provided a process for the preparation of PPTA fibers according to the wet spinning method comprising passing an optically anisotropic solution of a PPTA type polymer through a non-coagulating fluid layer and guiding the solution to a coagulating bath, characterized in that (a) filaments are taken out together with a stream of a coagulating solution from a fine tube or fine hole arranged in the lower portion of the coagulating bath and the filaments are travelled through a second fine tube or fine hole arranged below said fine tube or fine hole through a space, and (b) in the fine tube or fine hole arranged in the lower portion of the coagulating bath, the stream of the coagulating solution flowing out together with the filaments is accelerated and in the second fine tube or fine hole, the speed of the stream of the coagulating solution accompanying the filaments is decreased.

According to the present invention, there is also provided an apparatus for use in the high speed spinning of a poly-p-phenylene terephthalamid type polymer into fibers, comprising a coagulating bath tank having a fine tube or fine hole for taking out coagulated filaments together with a stream of a coagulating solution, arranged in the lower portion of the coagulating bath tank, and in contact with the coagulating bath tank, a sealed chamber comprising as a part thereof the bottom portion of the coagulating bath tank containing the fine tube or fine hole for taking out the coagulated filaments, said sealed chamber being comprised of an evacuating nozzle for reducing the pressure in the chamber and a second fine tube or fine hole for taking out the filaments to the exterior of the chamber, arranged at the lower end of the chamber.

DESCRIPTION OF THE PREFERRED EMBODIMENT

Figure 1:
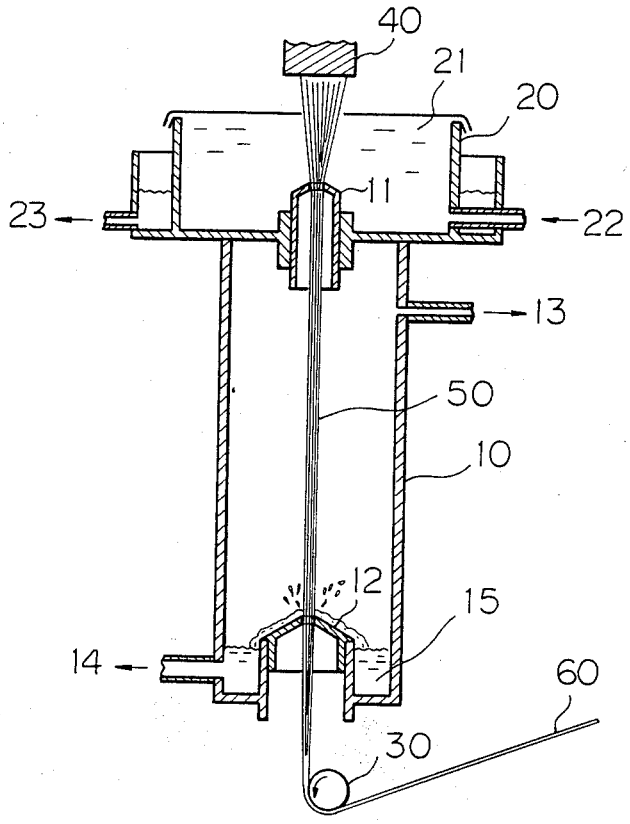
FIGS. 1 and 2 show spinning apparatuses suitably used in carrying out the process of the present invention.

In the present invention, by the term "PPTA type polymer" are meant poly-p-phenylene terephthalamide, a copolyamide in which up to 10 mole % of

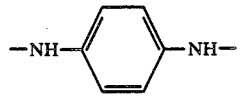

units and/or

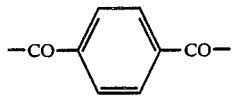

units of poly-p-phenylene terephthalamide are replaced by other aromatic diamino residue and/or other aromatic dicarboxyl residue, and a copolyamide comprising

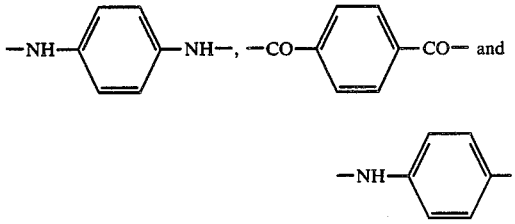

units. In the process of the present invention, these PPTA type polymers may be used singly or in the form of a blend of two or more of them.

High performance fibers having a strength of at least 18 g/d, an elongation of at least 3% and an initial modulus of at least 250 g/d should be intended in the process for the preparation of PPTA fibers according to the present invention. For this purpose, the polymerization degree of the PPTA type polymer to be used should be higher than a certain level. It is preferred that the polymerization degree expressed as the inherent viscosity ($\eta$inh) be at least 3.5, preferably at least 4.5.

A spinning dope to be used in the process of the present invention is prepared from the PPTA type polymer according to the known method. Concentrated sulfuric acid is industrially advantageously used as the solvent. It is preferred that the concentration of concentrated sulfuric acid be at least 95% by weight, and when a PPTA type polymer having a high inherent viscosity is dissolved at a high concentration, it is preferred that the concentration of concentrated sulfuric acid be at least 97.5% by weight, especially at least 99% by weight.

High performance fibers can be obtained easily as the polymer concentration in the spinning dope is high, and therefore, a higher polymer concentration is necessary. It is preferred that the polymer concentration in the spinning dope be at least 13% by weight, especially at least 15% by weight. However, at too high a polymer concentration, for example, at a polymer concentration higher than 22% by weight, the viscosity of the dope becomes too high and it is necessary to set the dope temperature at a high level, and the spinning operation often becomes difficult. When the dope is prepared or while it is used, it sometimes happens that the dope is solidified at temperatures close to room temperature if the polymer concentration is in the above-mentioned range. Accordingly, it is recommendable to handle the dope at a temperature of from room temperature to about 80° C. However, in order to avoid decomposition of the polymer as much as possible, a lower temperature not causing solidification should be selected.

It is confirmed that the so-prepared spinning dope has optically anisotropic characteristics if the polymer concentration and dope temperature are within the above-mentioned ranges. This dope is used in the process of the present invention, and the dope is once extruded into a non-coagulating fluid layer, ordinarily air, through a spinneret, and is then guided into a coagulating bath. In the coagulating bath, filaments which are being coagulated or have been coagulated, are not substantially drawn and, therefore, a drafting force (drawing force) is imposed on the extruded dope in the non-coagulating fluid layer and the extruded dope is drafted. If the draft ratio is low at this step, it is impossible to sufficiently increase the physical properties of fibers, and if the draft ratio is too high, the dope stream is broken. The draft ratio is ordinarily set at 4 to 15 and preferably at 5 to 12.

The length of the non-coagulating fluid layer where the dope is drafted, ordinarily the air layer, that is, the distance between the surface of the spinneret, from which the dope is extruded, and the surface of the coagulating solution in the coagulating bath, is adjusted ordinarily to 1 to 50 mm and preferably 3 to 20 mm, though this condition is not particularly critical. Namely, this distance should be determined while taking the speed of extruding the dope from the spinneret, the above-mentioned draft ratio and the cohering of filaments into consideration. The hole diameter of the spinneret used for extrusion of the dope should be determined according to the fineness of filaments to be prepared and the above-mentioned draft ratio. Ordinarily, a hole diameter of 0.05 to 0.10 mm is selected, though this value is not particularly critical. The number of holes formed in the spinneret should be determined according to the construction of fibers to be prepared, and the hole number is not particularly critical in carrying out the process of the present invention.

In carrying out the present invention, water or an aqueous solution of sulfuric acid having a concentration of up to 70% is advantageously used as the coagulating solution. However, the kind of the coagulating solution is not particularly critical. For example, an aqueous solution of a salt such as ammonium chloride, calcium chloride, calcium carbonate, sodium chloride or sodium sulfate or a mixture thereof, aqueous ammonia, an aqueous solution of sodium hydroxide, an organic solvent such as methanol, ethanol or ethylene glycol or an aqueous solution thereof may be used.

It is ordinarily preferred that the temperature of the coagulating solution be lower than 15° C., especially lower than 10° C.

In the process of the present invention for preparing high performance PPTA fibers at an industrially advantageously high speed, the dope extruded and drawn in the above-mentioned manner is guided to the coagulating bath. The process of the present invention is characterized in that while the dope is being formed into filaments, the filaments are taken out together with the stream of the coagulating solution from a fine tube or fine hole arranged in the lower portion of the coagulating bath, the filaments are then travelled through a second fine tube or fine hole arranged below the fine tube or fine hole through a space, and the stream of the coagulating solution falling down together with the filaments is accelerated in the fine tube or fine hole arranged in the lower portion of the coagulating bath and the speed of the stream of the accompanying coagulating solution is decreased in the second fine tube or fine hole arranged below the first fine tube or fine hole through a space.

During formation of PPTA fibers, the fibers are formed in accompany with such changes as fracture of a higher order structure formed in the course of coagulation and advance of the orientation. It should be understood that these factors are not merely expressed as functions of the tension but they are greatly changed according to the coagulation state of the filaments to which the tension is given.

In the case where PPTA fibers are prepared at a high spinning speed, since increase of the spinning tension and delay of coagulation due to shortening of the time of contact with the coagulating solution simultaneously take place with increase of the spinning speed, a high tension is given to uncoagulated filaments where coagulation is incomplete. Accordingly, in a process where a fine tube or fine hole is arranged in the lower portion of the coagulating bath and the coagulating solution is accelerated by the acceleration of gravity or a process in which the coagulating solution is forcibly accelerated by a downward jet stream, the spinning tension measured at the time of take-up is seemingly reduced, but a tension sufficient to cause fracture or promote orientation in the structure in filaments in which coagulation is incomplete is given by the accelerated stream of the coagulating solution, and therefore, PPTA fibers having sufficiently high strengh and elongation cannot be obtained.

Accordingly, in order to prepare high performance PPTA fibers having high strength and tension at a high spinning speed, it is necessary to reduce the tension of the filaments in the incomplete coagulation state so that fracture of the fiber structure is not caused even in uncoagulated filaments in which the degree of completeness of coagulation is low and advance of orientation resulting in reduction of the elongation is controlled. For this purpose, the stream of the coagulating solution accompanying the filaments is accelerated to reduce the frictional resistance between the filaments and the coagulating solution, the once accelerated stream of the coagulating solution is travelled through a space and the speed of the stream of the coagulating solution is then decreased, and coagulation is advanced while maintaining the tension imposed on the filaments during this period at a low level to form fibers. Hereupon, it must be understood that it is very important in the process of the present invention that a second fine tube or fine hole is arranged to reduce or decelerate the speed of the stream of the coagulating solution.

As pointed out hereinbefore, in order to prepare high performance PPTA fibers excellent in both the strength and the elongation, it is necessary to control the spinning tension according to the condition of the coagulation state of filaments. Especially when PPTA fibers excellent in both the strength and the elongation are prepared by adopting a spinning speed of at least 300 m/min, it is important that by accelerating the stream of the coagulating solution falling together with the filaments in the fine tube or fine hole arranged in the lower portion of the coagulating bath and decreasing the speed of the stream of the coagulating solution accompanying the filaments in the second fine tube or fine hole arranged below the above-mentioned fine tube or fine hole through a space, after the filaments have passed through the second fine tube or fine hole, the take-up tension (T) measured at separate positions of the stream of the accompanying coagulating solution and the factor (Ws/Wp) of the coagulation state indicating the ratio of removal of sulfuric acid as the solvent should be arranged to satisfy the condition expressed by the following formula (1):

$$1.425 \leqq T^{-0.20} \cdot (Ws/Wp)^{-0.11} \quad (1)$$

wherein T stands for the filament take-up tension in g/d, and Ws/Wp stands for the ratio of the weight (Ws) of pure sulfuric acid in the filaments downstream the second fine tube or fine hole to the weight (Wp) of the polymer in said filaments.

In case of uncoagulated filaments, it is necessary that the tension on the filaments should be further reduced as the degree of completion of coagulation is low. In contrast, in case of filaments in which the degree of completion of coagulation is high, fracture of the high structure is controlled even if the tension is relatively high.

In the process of the present invention, in the case where the value calculated from the tension and Ws/Wp does not satisfy the condition of the formula (1), the value of the tension or Ws/Wp is large enough to cause fracture of the higher order structure of the filaments and/or promotion of orientation between the fine tube or fine hole arranged in the lower portion of the coagulating bath and the second fine tube or fine hole, with the result that it is often difficult to obtain improved PPTA fibers having high strength and high elongation.

In the process of the present invention in which the coagulating solution is accelerated in the fine tube or fine hole arranged in the lower portion of the coagulating bath and the speed of the stream of the coagulating solution is decreased in the second fine tube or fine hole, the values of the spinning tension and Ws/Wp are changed according to the speed of the accelerated or decelerated coagulating solution, the flow amount thereof, the spinning speed and the kind of the coagulating solution used. Accordingly, if the process of the invention is carried out at a high spinning speed, preferably at least 300 m/min, it is preferred that the above-mentioned factors be determined so that the condition of the formula (1) is satisfied, and it is important that the following points should be taken into consideration.

The flow amount of the coagulating solution should be sufficient to form filaments from the dope at a set spinning speed, but if the flow amount is too large, an excessive tension is locally generated when the speed is reduced in the second fine tube or fine hole and hence, too large a flow amount is not preferred. Ordinarily, the flow amount is adjusted to a mass about 50 to about 500 times the mass of the filament-forming PPTA type polymer supplied per unit time.

The speed of the coagulating solution accelerated in the fine tube or fine hole arranged in the lower portion of the coagulating bath is an important factor for decreasing the spinning tension. In order to reduce the spinning tension, it is necessary to minimize the difference between the speed of the coagulating solution and the speed of the filaments travelled at the set spinning speed. In contrast, in order to promote coagulation and increase the degree of completion of coagulation, it is preferable to produce some difference between the speed of the coagulating solution and the travelling speed of the filaments so as to promote diffusion of the solvent. The speed of the stream of the accelerated coagulating solution should be determined while the above two points are taken into consideration. As the result of our research made based on the foregoing knowledges, it has been found that it is preferred that the speed of the stream of the accelerated coagulating solution be 0.5 to 2.0 times, preferably 0.7 to 1.5 times, the speed of the travelling filaments, that is, the spinning speed. If the speed of the stream of the coagulating solution is less than 0.5 time the spinning speed, the effect of reducing the spinning tension is insufficient and if the speed of the stream of the coagulating solution is more than 2.0 times the spinning speed, a strong tension is locally given to the filaments in the fine tube or fine hole, and therefore, the higher order structure of the filaments is readily broken, resulting in reduction of the properties of fibers.

The speed of the stream of the coagulating solution in the second fine tube or fine hole is decreased according to the method described in detail hereinafter. The degree of deceleration should be determined by the values of the spinning tension and the Ws/Wp ratio measured on the filaments which have passed through the second fine tube or fine hole. Namely, at such a high spinning speed as at least 300 m/min, by decreasing the speed of the stream of the coagulating solution in the second fine tube or fine hole, the spinning tension can be reduced to a level about 0.3 to about 0.8 time the spinning tension observed when the second fine tube or fine hole is not arranged and the speed of the stream of the coagulating solution is not decreased, at each set spinning speed. Accordingly, the values of the spinning tension and Ws/Wp are optionally set according to the set spinning speed so that the condition of the formula (1) is satisfied.

In the process of the present invention, as means for accelerating the stream of the coagulating solution in the fine tube or fine hole arranged in the lower portion of the coagulating bath and decreasing the speed of the stream of the coagulating solution in the second fine tube or fine hole, there may be adopted, for example, a method in which the fine tube or fine hole in the lower portion of the coagulating bath and the lower second fine tube or fine hole are arranged on the upper and lower ends, respectively, of an integral sealed chamber, and the pressure in the sealed chamber is reduced by an evacuating device, whereby the coagulating solution is accelerated in the fine tube or fine hole arranged in the lower portion of the coagulating bath and is decelerated in the second fine tube or fine hole.

As means suitably adopted at a spinning speed of at least 600 m/min, there can be mentioned a method in which the fine tube or fine hole in the lower portion of the coagulating bath and the lower second fine tube or fine hole are arranged on the upper and lower ends, respectively, of an integral sealed chamber, the non-coagulating fluid layer above the level of the coagulating bath, inclusive of a spinneret, is enclosed in a sealed structure, and the pressure of the non-coagulating fluid layer is increased over the atmospheric pressure, whereby the coagulating solution is compressed and the pressure in the sealed chamber is reduced. If this method is adopted, the effect of accelerating the coagulating solution in the fine tube or fine hole arranged in the lower portion of the coagulating bath can be enhanced as compared with the effect attained in the first-mentioned method. In this method, in order to obtain high performance PPTA fibers at a high spinning speed, it is preferred that the difference Δp between the pressure of the compressed fluid layer and the pressure in the sealed chamber should satisfy the condition expressed by the following formula (2):

$$0.74\times10^{-6}\cdot V^2 \leqq \Delta p \leqq 3.40\times10^{-6}\cdot V^2 \quad (2)$$

wherein Δp stands for the pressure difference ($Kg/cm^2$) and V stands for the spinning speed (m/min), as well as the condition of the above formula (1) is satisfied.

If the pressure difference Δp is outside the range defined by the formula (2), the difference between the speed of the stream of the fine tube or fine hole arranged in the lower portion of the coagulating bath the yarn take-up speed is increased and an excessive frictional resistance is locally generated, with the resulting that both the strength and the elongation of the obtained fibers are reduced.

As another specific means, there can be mentioned a method in which another coagulating solution or fluid is jetted from a plurality of small-diameter nozzles or slits and caused to impinge in the yarn take-up direction against the stream of the coagulating solution falling down from the fine tube or fine hole arranged in the lower portion of the coagulating bath, whereby the coagulating solution is accelerated, and a method in which a sealed compressed atmosphere is formed above the surface of the coagulating bath to effect the acceleration. It will readily be understood that the above-mentioned effects can similarly be attained according to these methods.

Furthermore, there may be adopted a method in which another gas or coagulating solution is jetted from a plurality of small-diameter nozzles or slits and caused to impinge against the coagulating solution just below the second fine tube or fine hole in the direction reverse to the yarn take-up direction, that is, upwardly, whereby the deceleration is effected, and a method in which a compressed atmosphere is formed below the second fine tube or fine hole. In some cases, sufficient effects can be attained by a method in which only a fine tube or fine hole having such a diameter that the coagulating solution accompanying the filaments is accumulated in the fine tube or fine hole is used as the second fine tube or fine hole.

Methods that can be adopted in the present invention are not limited to those exemplified above, and any of methods can be adopted, so far as the stream of the coagulating solution is accelerated in the fine tube or fine hole arranged in the lower portion of the coagulating bath and the speed of the stream of the coagulating solution is decreased in the fine tube or fine hole arranged below the above fine tube or fine hole through a space. The fine tube or fine hole arranged in the lower portion of the coagulating bath should be spaced from the second fine tube or fine hole through a space, except the filaments and the accompanying coagulating solution falling together with the filaments. More specifically, if this space is fully filled with the coagulating solution or a part of the space above the second fine tube or fine hole is particularly filled with the coagulating solution, an excessive frictional resistance between the filaments and the coagulating solution in this space or this part of the space is produced and the spinning tension cannot be reduced because of this excessive frictional resistance. Accordingly, it should be avoided that an excess of the coagulating solution other than the stream of the coagulating solution falling down together with the filaments is present above the second fine tube or fine hole. For this purpose, the coagulating solution left because of the deceleration in the second fine tube or fine hole should be positively removed from the travelling zone for the filaments and the stream of the coagulating solution accompanying the filaments.

For example, the apparatus shown in FIG. 1 is especially preferably used in the process of the present invention. In this apparatus, a fine tube or fine hole 11 in the lower portion of the coagulating bath and a second fine tube or fine hole 12 are arranged on the upper and lower ends, respectively, of an integral sealed chamber to define a reduced pressure chamber 10. The pressure in the chamber 10 is reduced from the outside through a pressure-reducing evacuating nozzle 13, whereby the speed of the stream of the coagulating solution is decreased in the second fine tube or fine hole 12 and the excessive coagulating solution is scattered and removed in the area above the second fine tube or fine hole 12. The coagulating solution retained in the reduced pressure chamber without flowing out in accompany with the filaments from the second fine tube or fine hole may be discharged from the pressure-reducing evacuating nozzle simultaneously with the evacuation. Alternatively, the retained coagulating solution may be discharged by sucking it using a coagulating solution discharge nozzle 14 provided on the reduced pressure chamber 10.

Figure 2:
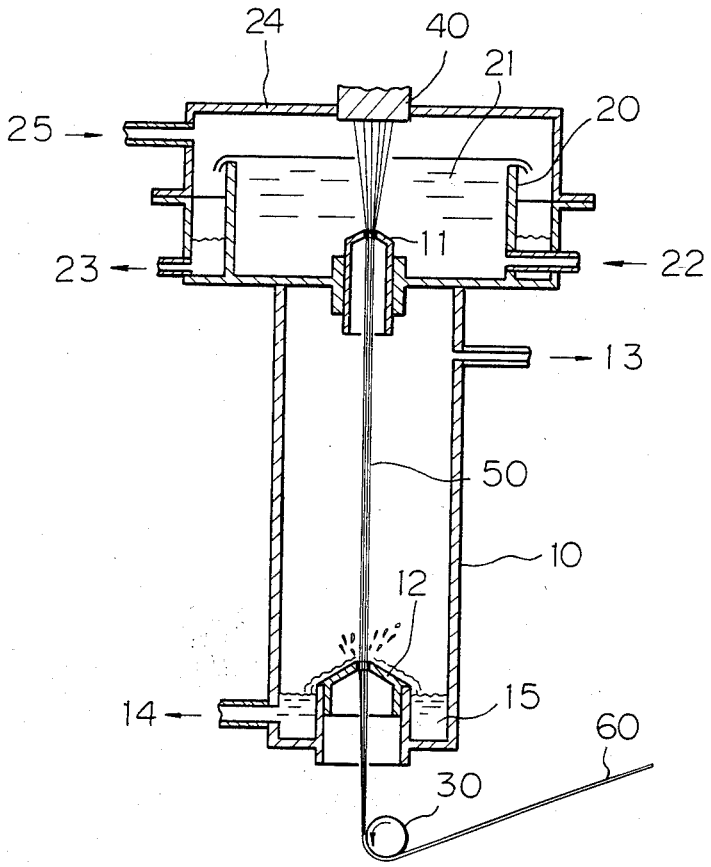

An apparatus which is especially preferably used in carrying out the process of the present invention is illustrated in FIG. 2. In this apparatus, a compressing chamber 24 for compressing the non-coagulating fluid layer above the surface of the coagulating solution is arranged in addition to the members of the apparatus shown in FIG. 1.

In each of the foregoing embodiments, the degrees of acceleration and deceleration of the stream of the coagulating solution should be adjustable as factors satisfying the condition of the formula (1) and preferably the condition of the formula (2). For example, in the foregoing embodiment, the adjustment can be accomplished according to the compressing force of the surface of the coagulating bath and the quantity and speed of another coagulating solution to be jetted. Furthermore, in the embodiment where fine tubes or fine holes are arranged on the upper and lower ends of the integral sealed chamber, the adjustment is accomplished according to the degree of reduction of the pressure in the sealed chamber.

The fine tube or fine hole arranged in the lower portion of the coagulating bath and the second fine tube or fine hole, which are used in carrying out the process of the present invention, are not particularly critical, and it is sufficient if they are arranged so that the condition of the formula (1) is satisfied. In short, the conditions of the fine tubes or fine holes should be determined according to such factors as the mass and flow rate of the coagulating solution. An important condition is the diameter of the fine tube or fine hole. The diameter of the fine tube or fine hole should be determined according to the mass and flow rate of the coagulating solution so that the sectional area of the fine tube or fine hole is 5 to 150 times, preferably 10 to 120 times, the sectional area of the filaments passing through the fine tube or fine hole, though the preferred range of the sectional area differs to some extent according to the structure of fibers to be prepared and the spinning speed. The sectional shape of the fine tube or fine hole is ordinarily circular, but the sectional shape of the fine tube or fine hole is not particularly critical in the process of the present invention. For example, a rectangular, triangular or ellipsoidal shape may be adopted. The length of the fine tube or fine hole is not particularly critical in the process of the present invention. For example, a fine tube in which the ratio of the length to the diameter is larger than 200 may be used. However, in case of too long a fine tube or fine hole, the frictional resistance between the tube or hole wall and the coagulating solution is increased and the acceleration or deceleration operation becomes difficult, and use of too long a fine tube or fine hole is not preferred. Ordinarily, a fine tube or fine hole in which the ratio of the length to the diameter is in the range of from 0.2 to 50 is advantageously used.

Figure 3A:
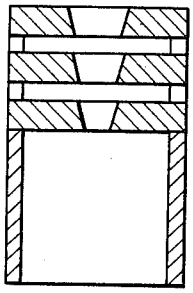
FIGS. 3(A) through 3(D) are enlarged views showing several preferred examples of the fine tubes or fine holes shown in FIGS. 1 and 2.
Figure 3B:
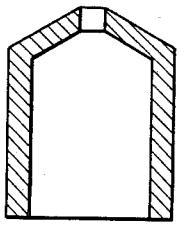
Figure 3C:
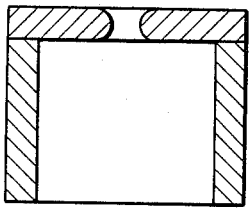
Figure 3D:
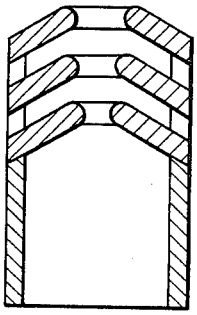

Fine tubes or fine holes as shown in FIGS. 3(A), 3(B), 3(C) and 3(D) may be used in the process of the present invention. A plurality of connected fine tubes or fine holes as shown in FIG. 3(A) or 3(D) may also be used. If necessary, in order to facilitate insertion and passage of the filaments, a tapered guide portion may be formed in the upper portion and/or the lower portion of the fine tube or fine hole. Moreover, in order to facilitate convection of the coagulating solution in the coagulating bath tank and flowing of the coagulating solution into the fine tube or fine hole, a rectifying plate or the like may be arranged above the fine tube or fine hole arranged in the lower portion of the coagulating bath. Disposition of these additional members is optional, so far as attainment of the intended object of the present invention is not hindered.

In carrying out the process of the present invention, the fine tube or fine hole is arranged in the lower portion of the coagulating bath and the second fine tube or fine hole is arranged below said fine tube or fine hole through a space. It is preferred that the fine tube or fine hole arranged in the lower portion of the coagulating bath be located within a depth of up to 200 mm. The dope extruded from the spinneret is guided into the coagulating bath through the non-coagulating fluid and simultaneously, coagulation is initiated while the spinning tension is imposed on the extrudate. In the coagulating bath, the filaments are travelled at the set spinning speed and simultaneously, the accompanying coagulating solution is accelerated. However, since the accompanying speed of the coagulating solution is lower than the speed of the filaments, a frictional resistance is caused and there is a risk of fracture of the higher order structure of the filaments being formed. Accordingly, in order to control fracture of the high structure of the filaments in the coagulating bath, it is preferred that the dope be passed through the fine tube or fine hole in the earlier stage and coagulation is advanced by the accelerated coagulating solution. From the foregoing viewpoint, we made investigation, and it was found that the fine tube or fine hole arranged in the lower portion of the coagulating bath should preferably be located within a depth of up to 200 mm, though the preferred extension length of the fine tube or fine hole differs to some extent according to the kind and concentration of the coagulating solution. Namely, it is ordinarily preferred that the fine tube or fine hole be located within 10 to 150 mm, especially 10 to 100 mm, from the surface of the coagulating bath.

The second fine tube or fine hole should be disposed below the above-mentioned fine tube or fine hole arranged in the lower portion of the coagulating bath through a space necessary for advancing coagulation sufficiently during the course of the travel of this space in the state where the tension is very low. It is ordinarily preferred that the second fine tube or fine hole be located at a position apart by 100 to 2000 mm, especially 250 to 600 mm, from the outlet of the fine tube or fine hole arranged in the lower portion of the coagulating bath.

The filaments formed by coagulation according to the process of the present invention are taken up from the second fine tube or fine hole at a high speed, preferably at least 300 m/min, especially preferably at least 600 m/min, by take-up means such as a Nelson roll, and the filaments are subjected to finishing steps such as neutralization of the adhering coagulating solution and the remaining solvent, sulfuric acid, washing and drying. Neutralization and washing of the acid contained in the formed filaments and washing of the salt formed by neutralization should be performed thoroughly in view of the quality of the finally obtained PPTA fibers, and long times are necessary for these treatments. For carrying out such thorough neutralization or washing over a period of a long time, these may be adopted in which many rolls are combined together so that the residence time is prolonged. However, in order to obtain fibers having a high quality on an industrial scale, it is preferable to adopt the method disclosed in U.S. Pat. No. 4,016,236 in which PPTA fibers are deposited on a net conveyor and in this state, water washing, neutralization and drying are carried out. Furthermore, in carrying out the process of the present invention, there may be adopted the method disclosed in U.S. Pat. No. 4,016,236 in which a heat treatment or the like is further carried out after drying on a net conveyor.

The process of the present invention is effectively applicable to the production of all the kinds of PPTA fibers. PPTA fibers are readily fibrilated or broken, probably because of a high crystallinity. Accordingly, it is preferred that the monofilament denier be not too large. Ordinarily, the monofilament denier is set at less than 10 and preferably at less than 3. The linear density of the total fibers is ordinarily 20 to 4500 denier and preferably 50 to 3000 denier.

The process for the preparation of PPTA fibers according to the present invention are advantageous over the conventional high-speed spinning processes for the production of PPTA fibers in that the strength is improved by 5 to 20% or more and the elongation is improved by about 15 to about 30% or more at such a high spinning speed as at least 300 m/min, preferably at least 600 m/min, irrespectively of the kinds of PPTA fibers. This excellent effect is especially prominent when an aqueous solution of sulfuric acid having a concentration lower than 70%, preferably 20 to 40%, is used as the coagulating solution. Therefore, the process of the present invention is very advantageous from the industrial viewpoint.

PPTA fibers obtained according to the process of the present invention are excellent in both the strength and the elongation, and therefore, they are very advantageously put into practical use.

PPTA fibers obtained according to the process of the present invention can be used as not only textile materials but also industrial materials, and they are especially advantageously used in the field where high strength and high elongation are fully utilized, for example, as rubber reinforcers or reinforcing fibers for plastic materials in the production of braided hoses, conveyor belts, air bags and the like.

The present invention will now be described in detail with reference to the following Examples that by no means limit the scope of the invention.

Incidentally, all of "%" and "parts" are by weight unless otherwise indicated. The main parameters used in the invention of this application were determined according to methods described below.

Method of Measurement of Inherent Viscosity

The polymer or fiber was dissolved in 98.5% by weight concentrated sulfuric acid at a concentration (C) of 0.5 g/dl at 30° C. and the inherent viscosity ($\eta$inh) was determined according to the following formula by customary procedures:

$\eta$inh=(ln·$\eta$rel)/C in which $\eta$rel represents a relative viscosity as measured using an Ostwald viscometer.

Method of Measurement of Strength and Elongation Characteristics of Fibers

The strength, elongation and Young's modulus of fibers or filaments were according to the method of the JIS (Japanese Industrial Standard). Namely, the filament was twisted at a twist number of 8 turns per 10 cm before the measurement, and the load-elongation curve was drawn at a grip length of 20 cm and a tensile speed of 50%/min in a constant-speed stretching type strength and elongation tester, and each characteristic was read or calculated from the obtained curve. The measurement was made on 20 samples and the mean value was calculated and shown.

Method of Measurement of Ratio Ws/Wp of Coagulated Filaments

The coagulated filaments taken out from the second fine tube or fine hole were wound at a distance of 2 m from the second fine tube or fine hole on a roll for a certain time to form a hank. The liquid was removed by performing centrifugal separation at 6000 rpm for 1 minute by using a centrifugal separator, and neutralization was effected by titration with 0.1N NaOH and the weight Ws of the acid was measured. After the titration, the fibers were washed and dried, and the weight Wp of the dried fibers was measured. Then, the ratio Ws/Wp was calculated.

Method of Measurement of Spinning Tension (Take-Up Tension)

The coagulated filaments taken out from the second fine tube or fine hole were deflected by a deflecting guide and taken up on a roll. During the course between the deflecting guide and the take-up roll, the tension value (g) was measured by a tension meter according to customary procedures. The spinning tension was determined by dividing this tension value by the denier of the filaments after water washing and drying. Namely, the spinning tension is expressed as the tension (g/d) per total denier of fibers. The measurement was made on 5 samples and the mean value was calculated and shown.

Method of Measurement of Coagulating Solution Speed

The speed of the coagulating solution was measured during spinning. During the continuous take-up of the filament at a certain speed, the coagulating solution flowing out together with the filaments from the fine tube or fine hole arranged in the lower portion of the coagulating bath was collected for a prescribed time of period and the volume of the collected solution was measured to determine the volume per unit time in $m^3$/min. This value was then divided by the cross-sectional area ($m^2$) of the fine tube or fine hole arranged in the lower portion of the coagulating bath to obtain the speed of the coagulating solution. Incidentally, in the case where a plurality of connected fine tubes or fine holes having different diameters as shown in FIGS. 3(A) or 3(D), the cross-sectional area of the fine tube or fine hole having the smallest diameter was used as the cross-sectional area of the fine tube or fine hole to determine the speed of the coagulating solution.

Method of Measurement of Fatigue Resistance of Fibers

There have been proposed various methods for typically evaluating the fatigue resistance of a tire or similar rubber product reinforced with fibers. In the present invention there was adopted the tube fatigue strength method A (Goodyear's method) described in Paragraph 1.3.2.1 of the Note of "Chemical Fiber Tire Cord Test Methods" of JIS 1017–1963. More specifically, a tubular test piece comprising adhesive-treated cords (treated cords) of a sample fiber embedded in a rubber in parallel to the axis was bent by 105° (90° in the above-mentioned method of JIS) and attached to an elongation-compression fatigue tester. Then, an inner pressure of 3.5 $Kg/cm^2G$ was applied to the test piece by air and the test piece was rotated at a rate of 850 turns per minute. The fatigue life of the tube was thus evaluated. The fatigue resistance of the tube comprising the fiber of the present invention was compared with that of the tube comprising the comparative fiber. With respect to each fiber, three samples were tested and the mean value of the fatigue life was calculated.

The fatigue resistance of a fiber cord is greatly changed according to the twist number of the cord, and it is known that within a certain range, a larger twist number ordinarily provides a better fatigue resistance. On the other hand, in case of fibers having a low elongation, increase of the twist number of the cord results in reduction of the ratio of the strength of the cord to the strength of the starting filament (strength utilization ratio). Accordingly, in order to effectively utilize the high strength of the starting filament, it is not preferable to increase the fatigue resistance by increasing the twist number. This point should be taken into consideration in evaluating the fatigue resistance of the fibers of the present invention. In the present invention, the above-mentioned fatigue resistance test was carried out while using the same twist structure in the cords. Namely, two-folded yarns were used and the twist multiplier was kept constant at 8.0. The twist multiplier referred to herein is expressed by the following formula:

$$\text{Twist multiplier} = (\text{twist number}/m) \times \sqrt{(\text{denier of yarn})}/2870$$

The treated cords to be subjected to the fatigue test were prepared under conditions described below in each case. Of course, the conditions described below are not sole conditions effective for exerting the characteristics of the present invention, but these conditions may be changed when the fibers of the present invention are actually used.

First twists and second twists were given and cords were prepared by twisting and doubling so that the above-mentioned twist multiplier was attained. Treated cords were prepared by applying an epoxy resin to a cord, treating the cord under a tension of 1 g/d at 250° C., applying a resorcinol-formalin latex (RFL) to the cord and subjecting the cord to a second treatment under a tension of $\frac{1}{3}$ g/d at 230° C.

The epoxy resin treatment liquid used was a dispersion comprising 3 parts of Epikote 812 (epoxy resin supplied by Shell Chemicals), 5 parts of ethanol, 25 parts of a polyvinylpyridine latex and 67 parts of water, and the RFL treatment liquid comprised 11 parts of resorcinol, 238.4 parts of water, 16.2 parts of 37% formalin, 0.3 part of NaOH and 244 parts of a polyvinylpyridine-styrene-butadiene latex (having a solid content of 41%). The RFL treatment liquid was used after it had been allowed to stand still over a whole day and night from the preparation.

The treated cords were embedded in an unvulcanized rubber, and the rubber was vulcanized at 140° C. for 40 minutes. The unvulcanized rubber used comprised 90 parts of natural rubber, 10 parts of a styrene-butadiene copolymer rubber, 40 parts of carbon black, 2 parts of stearic acid, 10 parts of a petroleum type softener, 4 parts of pine tar, 5 parts of zinc white, 1.5 parts of N-phenyl-$\beta$-naphthylamine, 0.75 part of 2-benzothiazolyl disulfide, 0.75 part of diphenylguanidine and 2.5 parts of sulfur.

REFERENTIAL EXAMPLE

A PPTA polymer was prepared according to a low-temperature solution polymerization process described below.

In a polymerization vessel disclosed in Japanese examined patent publication (Kokoku) No. 53-43986, 70 parts of anhydrous calcium chloride was dissolved in 1000 parts of N-methylpyrrolidone, and 48.6 parts of p-phenylene diamine was then dissolved. The solution was cooled to 8° C., and 91.4 parts of powdery terephthaloyl chloride was added at a time to the solution. After several minutes, the polymerization reaction product was solidified in the cheese-like form. According to the method disclosed in Japanese examined patent publication (Kokoku) No. 53-43986, the polymerization reaction product was withdrawn from the polymerization apparatus, immediately transferred into a biaxial sealed kneader and finely pulverized in the kneader. The finely pulverized reaction product was transferred into a Henschel mixer and water in an amount substantially equal to the amount of the pulverized reaction product was added, followed by further pulverization. The mixture was filtered, and the recovered solid was washed with warm water several times and then dried by hot air at 110° C. to obtain 95 parts of a light yellow PPTA polymer having an inherent viscosity of 6.2.

Polymers having an inherent viscosity different from the above-mentioned value could easily be obtained by changing the ratio of N-methylpyrrolidone to the monomers (p-phenylene diamine and terephthaloyl chloride) and/or the ratio between the monomers.

EXAMPLE 1

Poly-p-phenylene terephthalamide having an inherent viscosity ($\eta$inh) of 7.05 was dissolved in 99.7% concentrated sulfuric acid at 80° C. so that the polymer concentration was 18.7%, whereby a spinning polymer solution was prepared. By the polarized microscope observation under crossed Nicols, it was confirmed that this polymer solution was optically anisotropic.

The polymer solution was allowed to stand in vacuo for 2 hours to remove bubbles and was then used for spinning. The polymer solution was filtered by a candle filter comprising an eight-folded 300-mesh stainless steel net through a gear pump and extruded into a coagulating bath through an air layer having a length of 5 mm from a spinneret having 100 holes, each having a diameter of 0.07 mm. The coagulating solution used was 10% sulfuric acid cooled to 1.5° C.

The filaments extruded in the coagulating bath were taken up by a Nelson roll through an apparatus having a structure shown in FIG. 1.

This apparatus is integrated with a columnar coagulating bath tank 20 having a diameter of 200 mm and a depth of 100 mm and has a cylindrical portion having an inner diameter of 120 mm and a length of 450 mm, which is connected to the bottom plate of a coagulating bath 21. A pressure-reducing suction nozzle 13 and a coagulating solution discharge nozzle 14 are attached to the cylindrical portion to define a reduced pressure chamber 10. A tube 11 having a structure shown in FIG. 3(B) and also having a fine hole having an inner diameter of 2 mm and a length of 3 mm is arranged in the lower portion of the coagulating bath at a depth of 40 mm from the surface of the coagulating solution in the bath. In the bottom portion of the reduced pressure chamber, 430 mm below the fine hole, a tube 12 having a structure shown in FIG. 3(B) and also having an inner diameter of 1 mm and a length of 3 mm was arranged as the second hole.

At the spinning step, the filaments guided in the coagulating bath through the spinneret 40 were passed through the fine hole in the lower portion of the coagulating bath and the second fine hole and deflected by a deflecting roll 60, and the filaments 60 were taken up by the Nelson roll and wound on a bobbin by a winder. In the above-mentioned spinning apparatus, evacuation was effected through the pressure-reducing suction nozzle 13 by a vacuum pump so that the pressure in the reduced pressure chamber was maintained at a set level, and the coagulating liquid stagnant in the lower portion 15 of the second fine hole was sucked and discharged from the coagulating solution discharge nozzle 14 by a suction pump. In FIG. 1, reference numerals 22 and 23 respectively represent a coagulating solution feed nozzle and a coagulating solution discharge nozzle, and reference numeral 50 represents coagulated filaments.

The filaments wound on the bobbin were immersed in running water overnight together with the bobbin to effect washing, and the filaments were dried in a hot air drier maintained at 110° C.

According to the above-mentioned procedures, spinning was carried out at various spinning speeds and various pressure reduction degrees while maintaining the draft ratio (the ratio of the speed of extrusion of the polymer solution to the speed of take-up of the filaments) at 7.3. The physical properties of the obtained fibers are shown in Table 1.

As is apparent from the data shown in Table 1, it has been confirmed that in the process of the present invention, the filament take-up tension at the spinning step is much lower than in the known spinning processes carried out at the same spinning speed (Comparative Examples 1a, 1b and 1c), and fibers excellent in the physical properties and the strength and elongation can be obtained even at high spinning speeds according to the process of the present invention.

Incidentally, at each spinning speed, according to the process of the present invention, the coagulating solution could be separated from the filaments at a very high efficiency without disturbance of the filaments, and therefore, so-called fluffs were hardly observed in the obtained fibers.

COMPARATIVE EXAMPLE 1

For comparison, the spinning operation was carried out according to the conventional spinning process, that is, by using the coagulating bath tank not provided with the reduced pressure chamber 10 including the tube 12.

The same polymer solution as used in Example 1 was used and was similarly extruded into the coagulating bath through an air layer having a length of 5 mm from a spinneret having 100 holes, each having a diameter of 0.07 mm.

The coagulating bath and the composition and temperature of the coagulating bath were the same as in Example 1, and a fine hole having an inner diameter of 2 mm and a length of 3 mm was arranged at a depth of 40 mm from the surface of the coagulating solution in the bath. The filaments were deflected 450 mm below the fine hole by the deflecting roll, and the subsequent treatments were conducted in the same manner as described in Example 1 to obtain fibers.

The physical properties of the obtained fibers and the take-up tension at the spinning step are shown in Table 1. The obtained fibers were much inferior to the fibers obtained according to the process of the present invention in the physical properties and quality.

In the known spinning process not passing the filaments through the reduced pressure chamber, illustrated in this Comparative Example, scattering of the coagulating solution became conspicuous in the portion of the deflecting roll as the spinning speed was increased and winding of broken single filaments on the deflecting roll was conspicuous and many fluffs were observed in the obtained fibers. As is seen from the foregoing description, the obtained fibers were much inferior to the fibers obtained according to the process of the present invention in not only the physical properties but also the quality.

TABLE 1

| Run No. | Spinning Speed (m/min) | Pressure (Torr) in Reduced Pressure Chamber | Speed (m/min) of Coagulating Solution | Ratio of Speed of Coagulating Solution to Spinning Speed | Take-up Tension T (g/d) | Ws/Wp | $T^{-0.2} \cdot (Ws/Wp)^{-0.11}$ |
|---|---|---|---|---|---|---|---|
| 1 | 300 | 490 | 349 | 1.16 | 0.11 | 0.31 | 1.769 |
| 2 | 400 | 460 | 530 | 1.33 | 0.18 | 0.33 | 1.592 |
| 3 | 500 | 430 | 594 | 1.19 | 0.25 | 0.34 | 1.485 |
| 4-a | | 510 | 308 | 0.51 | 0.31 | 0.32 | 1.433 |
| 4-b | | 460 | 573 | 0.95 | 0.27 | 0.35 | 1.458 |
| 4-c | 600 | 360 | 650 | 1.08 | 0.26 | 0.33 | 1.479 |
| 4-d | | 260 | 678 | 1.13 | 0.23 | 0.33 | 1.516 |
| 4-e | | 190 | 707 | 1.18 | 0.20 | 0.36 | 1.544 |
| 4-f | | 620 | 285 | 0.47 | 0.52 | 0.34 | 1.283 |
| 5 | 300 | — | 131 | — | 0.32 | 0.27 | 1.451 |
| 6 | 400 | — | 165 | — | 0.48 | 0.33 | 1.308 |
| 7 | 600 | — | 234 | — | 0.77 | 0.38 | 1.172 |

| Run No. | Denier Number | Tensile Strength Elongation: Tensile Strength (g/d) | Tensile Strength Elongation: Elongation (%) | Initial Modulus (g/d) | Remarks |
|---|---|---|---|---|---|
| 1 | 153 | 24.9 | 4.8 | 316 | |
| 2 | 151 | 23.6 | 4.8 | 337 | |
| 3 | 154 | 23.1 | 4.6 | 324 | |
| 4-a | 148 | 20.8 | 4.9 | 350 | |
| 4-b | 151 | 22.8 | 4.4 | 339 | |
| 4-c | 150 | 23.1 | 4.6 | 334 | |
| 4-d | 152 | 22.5 | 4.7 | 356 | |
| 4-e | 149 | 21.9 | 4.5 | 340 | |
| 4-f | 156 | 19.6 | 4.2 | 407 | |
| 5 | 150 | 21.6 | 4.2 | 394 | Comparative Example 1a |
| 6 | 149 | 20.4 | 4.3 | 401 | Comparative Example 1b |
| 7 | 154 | 18.7 | 4.0 | 370 | Comparative Example 1c |

EXAMPLES 2 through 5

Poly-p-phenylene terephthalamide having an inherent visocisty $\eta inh$ of 7.96 was dissolved in 99.7% concentrated sulfuric acid at 70° C. over a period of 2 hours so that the polymer concentration was 18.5%. The dissolving operation was conducted in vacuo. The formed solution was allowed to stand still for 2 hours to remove bubbles, and the solution was then used for spinning.

The dope was extruded from a spinneret having 500 holes, each having a diameter of 0.07 mm, so that the draft ratio was 7.3. The extrudate was travelled through a space having a length of 10 mm and guided into a coagulating bath containing water, 15% dilute sulfuric acid or 30% dilute sulfuric acid adjusted at 0 to 3° C. The spinning operation was carried out by using the same apparatus of the sealed reduced pressure room type shown in FIG. 1 as used in Example 1. The fine hole arranged in the lower portion of the coagulating bath had a shape shown in FIG. 3(B) and also had an inner diameter of 4.5 mm and a length of 10 mm. The fine hole was located at a depth of 60 mm from the surface of the coagulating solution in the bath. A 3-stage fine hole including three piled stainless steel perforated plates and having a structure shown in FIG. 3(A) was arranged 600 mm below the above-mentioned fine hole. Each perforated plate had a thickness of 3 mm and the distance between the two perforated plates was 2 mm. The diameter of the fine hole at the topmost stage was 4 mm at the upper end and 3 mm at the lower end, the diameter of the fine hole at the second stage was 3.5 mm at the upper end and 2.5 mm at the lower end, and the diameter of the fine hole at the lowermost stage was 3 mm at the upper end and 2 mm at the lower end.

The filaments formed in the coagulating bath were passed through the respective fine holes of the above-mentioned apparatus and travelled under conditions shown in Table 2, and the filaments were deflected by the deflecting roll, taken up by the Nelson roll and treated by the apparatus (FIG. 4) shown in U.S. Pat. No. 4,016,236. More specifically, the filaments 60 were placed on a reversing net 76 by a pair of gear nip rolls (geared rolls engaged shallowly with each other and the filaments were fed through between the rolls), and the filaments were reversed and placed on a treating conveyor 77. The filaments placed on the treating conveyor 77 was washed with a shower of washing water 78. Then, an oiling liquid comprising 1% of a mineral oil dispersed in water by an emulsifier was applied to the filaments and the filaments were dried by a hot air heater 79 maintained at 200° C. On the conveyor 77, the filaments were in the absence of a tensioning force.

Figure 4:
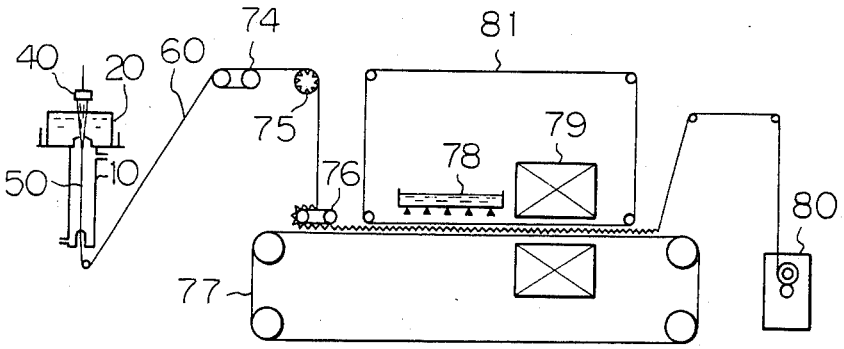
FIG. 4 is a schematic diagram illustrating the entire structure of a spinning system preferably used in carrying out the process of the present invention.

Then, the filaments were taken up from the conveyor and wound on a bobbin by a winder in the winding zone 80. In FIG. 4, reference numeral 74 represents a take-up Nelson roll, 75 a gear nip roll, and 81 a fleece pressing cover net.

The properties of the so-obtained fibers are shown in Table 2. From the data shown in Table 2, it will readily be understood that even if 15% or 30% dilute solution is used as the coagulating solution in the process of the present invention, fibers having a high strength and an especially high elongation can be obtained and even if the spinning speed is as high as at least 300 m/min, fibers having excellent properties can be obtained.

On the other hand, in Comparative Examples 2 and 3 (known processes) given below, when water was used as the coagulating liquid, the strength was substantially satisfactory but the elongation was very low. When a coagulating liquid of the dilute sulfuric acid type was used, also the strength was extremely reduced and only fibers having poor properties were obtained.

The fatigue resistance was measured by using the fibers obtained in Examples 2, 4 and 5 are Comparative Examples 2 and 3. The obtained results are shown in Table 3. From the data shown in Table 3, it will readily be understood that the fibers obtained according to the present invention are very excellent in the practical utility.

COMPARATIVE EXAMPLES 2 AND 3

The same spinning dope as used in Examples 2 through 5 was used and was extruded into a space under the same extruding conditions as described in Examples 2 through 5, and the extrudate was guided into the coagulation bath. The filaments and coagulating solution were let to fall down through the same fine hole as arranged in the portion of the coagulating bath in Examples 2 through 5. This fine hole was located at a depth of 60 mm from the surface of the coagulating solution in the bath. As in Comparative Example 1, no means for accelerating the coagulating solution accompanying the filaments was disposed, and the second fine hole was not arranged. The taken-out filaments were deflected by the deflecting roll 600 mm below the fine hole. Then, in the same manner as described in Examples 2 through 5, the filaments were washed with water and dried on the conveyor to obtain fibers. The properties of the obtained fibers are shown in Table 2. As pointed out hereinbefore, the obtained fibers were much inferior to the fibers of the present invention in the properties.

TABLE 2

| Example No. | Coagulating Solution | Spinning Speed (m/min) | Pressure (Torr) in Reduced Pressure Chamber | Take-up Tension T (g/d) | Ws/Wp | $T^{-0.2}\cdot(Ws/Wp)^{-0.11}$ | Physical Properties of Fibers: Denier Number | Tensile Strength (g/d) | Elongation (%) | Initial Modulus (g/d) |
|---|---|---|---|---|---|---|---|---|---|---|
| 2 | Water | 350 | 480 | 0.13 | 0.33 | 1.699 | 762 | 24.7 | 4.9 | 336 |
| 3 | Water | 450 | 465 | 0.27 | 0.35 | 1.458 | 749 | 23.8 | 4.7 | 363 |
| 4 | 15% $H_2SO_4$ | 400 | 370 | 0.22 | 0.46 | 1.474 | 753 | 24.2 | 4.5 | 379 |
| 5 | 30% $H_2SO_4$ | 300 | 265 | 0.20 | 0.51 | 1.486 | 751 | 23.5 | 4.6 | 347 |
| Comparative Example 2 | Water | 350 | — | 0.34 | 0.34 | 1.397 | 756 | 20.4 | 3.8 | 396 |
| Comparative Example 3 | 30% $H_2SO_4$ | 300 | — | 0.46 | 0.47 | 1.272 | 748 | 19.7 | 3.4 | 432 |

TABLE 3

| Fibers Used at Fatigue Resistance Test | Fatigue Life (minutes) of Tube |
|---|---|
| fibers obtained in Example 2 | 1250 |
| fibers obtained in Example 4 | 1084 |
| fibers obtained in Example 5 | 950 |
| fibers obtained in Comparative Example 2 | 630 |
| fibers obtained in Comparative Example 3 | 495 |

EXAMPLE 6

PPTA fibers were prepared in the same manner as described in Example 1 except that spinning apparatus shown in FIG. 2 was used instead of the spinning apparatus shown in FIG. 1.

The physical properties of the obtained fibers are shown in Table 4.

TABLE 4

| Run No. | Spinning Speed (m/min) | Inner Pressure ($Kg/cm^2$) of Compressing Chamber | Inner Pressure ($Kg/cm^2$) of Reduced Pressure Chamber | Pressure Difference Δp ($Kg/cm^2$) | Speed (m/min) of Coagulating Solution | Take-up Tension T (g/d) | Ws/Wp |
|---|---|---|---|---|---|---|---|
| 1 | 600 | 1.15 | 0.80 | 0.35 | 592 | 0.18 | 0.33 |
| 2 | | 1.07 | 0.55 | 0.52 | 721 | 0.25 | 0.34 |
| 3 | | 1.13 | 0.35 | 0.78 | 883 | 0.23 | 0.33 |
| | 800 | | | | | | |
| 4 | | 1.00 | 0.60 | 0.40 | 623 | 0.39 | 0.32 |
| 5 | | 2.30 | 0.10 | 2.20 | 1480 | — | — |
| 6 | 1000 | 1.27 | 0.22 | 1.05 | 1025 | 0.31 | 0.32 |

| Run No. | $T^{-0.2}(Ws/Wp)^{-0.11}$ | Properties of Fibers: Denier Number | Tensile Strength (g/d) | Tensile Elongation (%) | Initial Modulus (g/d) | Remarks |
|---|---|---|---|---|---|---|
| 1 | 1.592 | 152 | 24.1 | 4.6 | 324 | |
| 2 | 1.485 | 152 | 23.1 | 4.7 | 342 | |
| 3 | 1.516 | 154 | 23.6 | 4.8 | 339 | |
| 4 | 1.368 | 153 | 19.8 | 4.2 | 437 | Outside scope of present invention |
| 5 | — | — | — | — | — | Outside scope of present invention (no filaments were taken up) |
| 6 | 1.433 | 148 | 20.4 | 4.1 | 415 | |

This Example was different from Example 1 in the point where the air gap portion was compressed above the atmospheric pressure to enhance the accelerating effect in the fine tube arranged in the lower portion of the coagulating bath, whereby the spinning speed was further increased.

The used apparatus shown in FIG. 2 comprised a coagulating bath tank (200 mm in diameter and 100 mm in depth) having a cylindrical reduced pressure chamber having an inner diameter of 120 mm and a length of 450 mm, which was connected to the bottom plate of the coagulating bath 20, and a sealing compressing chamber 24 for compressing the coagulating solution. A nozzle 25 for introduction of a compressed fluid (compressed air in this Example) was attached to the compressing chamber. In the coagulating bath tank provided with the sealed chamber, a fine hole of the structure shown in FIG. 3(B) having an inner diameter of 2 mm and a length of 3 mm was arranged at a depth of 40 mm from the surface of the coagulating solution in the bath, and a second fine hole 12 of the structure shown in FIG. 3(B) having an inner diameter of 1 mm and a length of 3 mm was arranged 430 mm below said fine hole 11. Furthermore, a pressure-reducing evacuating nozzle 13 and a liquid discharge nozzle 14 were attached to the coagulating bath tank.

At the spinning operation, compressed air was fed through the fluid-introducing nozzle 25, and evacuation was effected from the pressure reducing evacuating nozzle 13 by means of a vacuum pump, so that predetermined pressures were maintained at the respective parts. The coagulating solution present in the lower portion of the second fine hole was discharged from the liquid discharge nozzle 14 by means of a suction pump.

EXAMPLE 7

In this Example, the apparatus shown in FIG. 2, which was used in Example 6, was used. The spinning operation was carried out in the same manner as described in Example 6 except that a copolymer having an inherent viscosity (ηinh) of 5.1 in which 10 mole % of p-phenylene diamine of PPTA was replaced by 4,4'-diaminobenzanilide, was used as PPTA type polymer, and the polymer was dissolved in 99.0% concentrated sulfuric acid as the solvent so that the polymer concentration was 19%. The varied spinning conditions and the properties of the obtained fibers are shown in Table 5 as Examples 7*a* and 7*b*.

Then, the above-mentioned spinning operation was repeated, except that the pressure-reducing evacuating nozzle 13 was opened to the outer atmosphere and the pressure in the reduced pressure chamber 10 was not reduced, and acceleration of the coagulating solution in the fine hole 11 was effected by increasing the pressure of the non-coagulating fluid layer in the compressing chamber 24 above the atmospheric pressure. The results are shown in Table 5 as Examples 7*c* and 7*d*.

In Table 5, there are also shown the results of the following Comparative Example 4.

COMPARATIVE EXAMPLE 4

The spinning operation was carried out in the same manner as described in Example 7 except that from the apparatus shown in FIG. 2, which was used in Example 7, the second fine hole 12 arranged in the lower portion of the sealed chamber was removed and filaments taken out from the fine hole 11 were directly guided to the roll 30.

TABLE 5

| | Inner | Inner Pressure |
|---|---|---|

TABLE 5-continued

| Example No. | Spinning Speed (m/min) | Pressure ($Kg/cm^2$) of Compressing Chamber | ($Kg/cm^2$) of Reduced Pressure Chamber | Pressure Difference Δp ($Kg/cm^2$) | Speed (m/min) of Coagulating Solution | Take-up Tension T (g/d) |
|---|---|---|---|---|---|---|
| 7a | 600 | 1.15 | 0.80 | 0.35 | 590 | 0.18 |
| 7b | 800 | 1.50 | 0.80 | 0.70 | 810 | 0.24 |
| 7c | 600 | 1.15 | 1.00 | 0.15 | 300 | 0.30 |
| 7d | 800 | 1.50 | 1.00 | 0.50 | 690 | 0.27 |
| Comparative Example 4a | 600 | 1.15 | 1.00 | 0.15 | 300 | 0.31 |
| Comparative Example 4b | 800 | 1.50 | 1.00 | 0.50 | 690 | 0.29 |

| Example No. | (Ws/Wp) | $T^{-0.2}(Ws/Wp)^{-0.11}$ | Physical Properties of Fibers: Denier Number | Strength (g/d) | Elongation (%) | Initial modulus (g/d) |
|---|---|---|---|---|---|---|
| 7a | 0.34 | 1.587 | 153 | 22.1 | 5.0 | 310 |
| 7b | 0.35 | 1.493 | 152 | 21.3 | 4.8 | 310 |
| 7c | 0.33 | 1.437 | 153 | 21.5 | 4.9 | 310 |
| 7d | 0.35 | 1.458 | 152 | 20.6 | 4.7 | 305 |
| Comparative Example 4a | 0.36 | 1.414 | 153 | 19.3 | 4.5 | 315 |
| Comparative Example 4b | 0.40 | 1.417 | 152 | 17.9 | 4.1 | 315 |

EXAMPLES 8 through 10

The preparation of the dope and the spinning operation were carried out in the same manner as described in Examples 2 through 5 except that the spinning apparatus shown in FIG. 2 was used instead of the spinning apparatus shown in FIG. 1. The obtained filaments were washed with water and dried according to the method and apparatus disclosed in U.S. Pat. No. 4,016,236, whereby PPTA fibers were obtained.

The spinning condition, other modified conditions and physical properties of the obtained fibers are shown in Table 6.

With respect to each of the fibers obtained in Examples 8 through 10, the fatigue resistance was determined. The obtained results are shown in Table 7 given below. From the data shown, it will readily be understood that fibers obtained according to the process of the present invention have a very high practical utility because of excellent physical properties thereof.

TABLE 6

| Example No. | Coagulating Solution | Spinning Speed (m/min) | Inner Pressure ($Kg/cm^2$) of Compressing Chamber | Inner Pressure ($Kg/cm^2$) of Reduced Pressure Chamber | Pressure Difference Δp ($Kg/cm^2$) | Speed (m/min) of Coagulating Solution | Take-up Tension T (g/d) |
|---|---|---|---|---|---|---|---|
| 8 | Water | 600 | 1.09 | 0.75 | 0.34 | 584 | 0.22 |
| 9 | Water | 800 | 1.20 | 0.65 | 0.55 | 742 | 0.24 |
| 10 | 15% $H_2SO_4$ | 600 | 1.22 | 0.60 | 0.62 | 607 | 0.27 |

| Example No. | Ws/Wp | $T^{-0.2}(Ws/Wp)^{-0.11}$ | Physical Properties of Fibers: Denier Number | Strength (g/d) | Elongation (%) | Initial modulus (g/d) |
|---|---|---|---|---|---|---|
| 8 | 0.35 | 1.519 | 749 | 24.3 | 4.7 | 363 |
| 9 | 0.36 | 1.489 | 752 | 23.7 | 4.6 | 369 |
| 10 | 0.42 | 1.429 | 753 | 23.5 | 4.5 | 347 |

TABLE 7

| Fibers Used for Measurement of Fatigue Resistance | Fatigue Life (minutes) of Tube |
|---|---|
| fibers obtained in Example 8 | 1130 |

TABLE 7-continued

| Fibers Used for Measurement of Fatigue Resistance | Fatigue Life (minutes) of Tube |
|---|---|
| fibers obtained in Example 9 | 1005 |
| fibers obtained in Example 10 | 940 |

We claim:

1. A process for the preparation of poly-p-phenylene terephthalamide fibers having improved mechanical properties at high spinning speeds according to the wet spinning method comprising passing an optically anisotropic solution of a poly-p-phenylene terephthalamide type polymer through a non-coagulating fluid layer and guiding the solution to a coagulating bath, characterized in that (a) filaments are taken out together with a steam of coagulating solution from a first fine tube or fine hole arranged in the lower portion of the coagulating bath and the filaments travel through a second fine tube or fine hole arranged below and spaced from said first fine tube or fine hole, wherein the first fine tube or fine hole arranged in the lower portion of the coagulating bath and the second fine tube or fine hole are arranged on the upper and lower ends, respectively, of an interal sealed chamber, and the pressure in the sealed chamber is reduced by an evacuating device to accelerate the stream of the coagulating solution flowing out together with the filaments through the first fine tube or fine hole arranged in the lower portion of the coagulaing bath and decrease the speed of the steam of the coagulating solution accompanying the filaments in the lower second fine tube or fine hole.

2. A process according to claim 1, wherein the poly-p-phenylene terephthalamide type polymer is selected from the group consisting of poly-p-phenylene terephthalamide, copolymides in which up to 10 mole % of

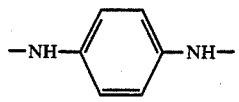

units and/or

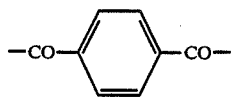

units of poly-p-phenylene terephthalamide are replaced by other aromatic diamino residue and/or other aromatic dicarboxyl residue, and copolyamides comprising

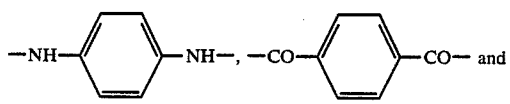

and

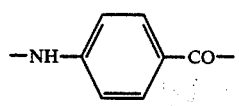

units.

3. A process according to claim 2, wherein the poly-p-phenylene terephthalamide type polymer has an inherent viscosity of at least 3.5.

4. A process according to claim 1, wherein a solution of a poly-p-phenylene terephthalamide type polymer in concentrated sulfuric acid of a concentration of at least 95% by weight is used as the solution of a poly-p-phenylene terephthalamide type polymer.

5. A process according to claim 4, wherein the solution has a polymer concentration of at least 13% by weight.

6. A process as claimed in claim 1, wherein the stream of the solution of a poly-p-phenylene terephthalamide type polymer being passed through the non-coagulating fluid layer is drafted at a draft ratio of 4 to 15.

7. A process according to claim 1, wherein water, an aqueous solution of sulfuric acid having a concentration of up to 70%, an aqueous solution of ammonium chloride, calcium chloride, calcium carbonate, sodium chloride or sodium sulfate or a mixture thereof, aqueous ammonia, an aqueous solution of sodium hydroxide, methanol, ethanol, ethylene glycol, or an aqueous solution of methanol, ethanol of thylene glycol is used as the coagulating solution.

8. A process according to claim 7, wherein the coaqulating solution is maintained to a temperature of lower than 15° C.

9. A process according to claim 1, wherein the spinning speed is at least 300 m/min, and the tension for taking up the filaments from the second fine tube or fine hole and the factor (Ws/Wp) indicating the coagulation state of the filaments taken out from the second fine tube or fine hole satisfy the condition expressed by the following formula (1):

$$1.425 \leqq T^{-0.20} \times (Ws/Wp)^{-0.11} \quad (1)$$

wherein T stands for the filament take-up tension (g/d), and Ws/Wp stands for the ratio of the weight (Ws) of pure sulfuric acid in the filaments passed through the second fine tube or fine hole to the weight (Wp) of the polymer in said filaments.

10. A process according to claim 1, wherein in the first fine tube or fine hole arranged in the lower portion of the coagulating bath, another compressed and jetted coagulating solution is caused to impinge downwardly against the filaments and accompanying coagulating solution stream.

11. A process according to claim 1, wherein the solution of the coagulating bath is compressed through the non-coagulating fluid layer to accelerate the stream of the coagulating solution in the first fine tube or fine hole arranged in the lower portion of the coagulating bath.

12. A process according to claim 1, wherein the first fine tube or fine hole arranged in the lower portion of the coagulating bath and the lower second fine tube or fine hole are arranged on the upper and lower ends, respectively, of an integral sealed chamber connected to an evacuating device and the pressure in the sealed chamber is reduced, and the non-coagulating fluid layer above the level of the coagulating bath, inclusive of a spinneret, is enclosed in a sealed structrue and the pressure of the non-coagulating fluid layer is increased to a level higher than atmospheric pressure, whereby the stream of the coagulating solution is acceleratedin the first fine tube or hole arranged in the lower portion of the coagulating bath and the speed of the stream of the coagulating solution is decreasd in the lower second fine tube or fine hole.

13. A process according to claim 12, wherein the spinning speed is at least 600 m/min, and the tension for taking up the filaments from the second fine tube or fine hole and the factor (Ws/Wp) indicating the coagulation state of the filaments taken out from the second fine tube or fine hole satisfy the condition expressed by the following formula (1):

$$1.425 \leqq T^{-0.20} \times (Ws/Wp)^{-0.11} \quad (1)$$

wherein T stands for the filament take-up tension (g/d) and Ws/Wp stands for the ratio of the weight (Ws) of pure sulfuric acid in the filaments downstream the second fine tube or fine hole to the weight (Wp) of the polymer in said filaments, and the pressure difference Δp between the pressure of the compressed fluid layer and he pressure within the sealed chamber satisfies the condition expressed by the following formula (2):

$$0.74 \times 10^{-6} \cdot V^2 \leqq \Delta p \leqq 3.40 \times 10^{-6} \cdot V^2 \quad (2)$$

wherein Δp stands for the pressure difference ($Kg/cm^2$) and V stands for the spinning speed.

* * * * *